US005356854A

United States Patent [19]

Ito

[11] Patent Number: 5,356,854

[45] Date of Patent: Oct. 18, 1994

[54] DYE AND DYE CARRIER INK RIBBON FOR THERMAL DYE TRANSFER HARD COPY

[75] Inventor: Kengo Ito, Kanagawa, Japan

[73] Assignee: Sony Corporation, Tokyo, Japan

[21] Appl. No.: 828,130

[22] Filed: Jan. 30, 1992

[30] Foreign Application Priority Data

Jan. 30, 1991 [JP] Japan ..... 3-010204

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914, 480; 503/227

[56] References Cited

U.S. PATENT DOCUMENTS 4,270,916 6/1981 Racciato ..... 8/527

FOREIGN PATENT DOCUMENTS 0178832 4/1986 European Pat. Off. ..... 503/227
0273307 7/1988 European Pat. Off. ..... 503/227
0405219 1/1991 European Pat. Off. ..... 503/227
0405296 1/1991 European Pat. Off. ..... 503/227

OTHER PUBLICATIONS

Chemical Abstracts, vol. 106, No. 2, Jan. 12, 1987, Abstract No. 6321J.

*Primary Examiner*—B. Hamilton Hess
*Attorney, Agent, or Firm*—Hill, Steadman & Simpson

[57] ABSTRACT

Cationic dyes and dye carrier ink ribbons are disclosed which is used in thermal dye transfer hard copy system. A counter ion (anion) of hydrophilic cationic dyes such as a halogen ion is replaced by anionic surface active agent such a dodecylbezenesulfonate ion through ion exchange treatment to obtain a dye having a structure of the following formula. The dye is used to form a coloring layer on a PETP film to obtain a dye carrier ink ribbon for thermal dye transfer systems.

2 Claims, 4 Drawing Sheets

DYE AND DYE CARRIER INK RIBBON FOR THERMAL DYE TRANSFER HARD COPY

BACKGROUND OF THE INVENTION

This invention relates to a dye and a dye carrier ink ribbon for thermal dye transfer system hard copy which is suitably adapted for use, for example, as a color hard copying material of video printers.

In video printers, it is recently practiced to form a dye carrier ink ribbon by coating disperse dyes dissolved in hydrophobic high molecular weight materials on a ribbon substrate and form an image by causing thermal transfer of the dye from the dye carrier ink ribbon to a second hydrophobic high molecular weight material provided on an acceptor sheet such as a synthetic paper, wherein the thermal transfer of the dye is controlled according to a video signal to be printed synthetic paper. It will be noted that although it has been hitherto accepted as desired that the dye has sublimating properties in view of the principle of forming an image, more importance is placed on thermal diffusing properties than on the sublimating properties in view of a recent trend of investigations wherein the types of materials used therefor a taken into consideration.

The reason why disperse dyes are employed for this purpose is based on the fact that the disperse dye is hydrophobic in nature and the ink ribbon is appropriately fixed to a substrate, with a good practical sensitivity at the time of the transfer.

However, when disperse dyes are used as a dye for ink ribbons, there arises the problem that the sensitivity, hue and light fastness are not always satisfactory at the time of the transfer.

On the other hand, there are known cationic dyes which have good brightness inherent to basic materials and high coloring properties and which are used as a dye for acrylic fibers. The dye may be applied to as a dye for ink ribbons for the hard copy. Although cationic dyes exhibit good light fastness and wet fastness on acrylic substrates, they have hydrophilicity, so that it is difficult to stably, uniformly fix on a resin such as polyethylene terephtalate (PETP) which is ordinarily used as a substrate of ribbon. Thus, it is not possible to form an ink ribbon for thermal transfer by the use of cationic dyes.

OBJECT OF THE INVENTION

Under these circumstances in the art, it is an object of the present invention to provide a dye and a dye carrier ink ribbons of thermal transfer system hard copy wherein cationic dyes which have not be employed as an image-forming material in hitherto thermal transfer systems are used whereby sensitivity, hue and light fastness can be improved.

DESCRIPTION OF THE PREFERRED EMBODIMENTS

The dye for ink ribbons of thermal transfer systems according to the invention is obtained by exchanging an inorganic counter ion of a hydrophilic cationic dye with a hydrophobic organic ion.

The ink ribbon for the thermal transfer system according to the invention is obtained by forming a coloring layer on a support from the dye of claim 1.

In the dye for ink ribbons of thermal transfer systems of the invention, the inorganic counter ion of a hydrophilic cationic dye is exchanged with a hydrophobic organic ion, so that the dye is sparingly soluble in water and has increased compatibility wit non-aqueous solvents and hydrophobic high molecular weight materials.

The formation of the coloring layer made of the dye of the invention on the support ensures uniform and stable fixing of the cationic dye on the support.

[EXAMPLES]

One example of the invention is described with reference to the accompanying drawings.

In this example, an oxazine cationic dye for dyeing acrylic fibers (commercial name: AIZEN Catiron Pure Blue, available from Hodogaya Chem, Ind. Co., Ltd.) is used.

The cationic dye has a structural formula shown in Chem. 1

[Chem. 1]

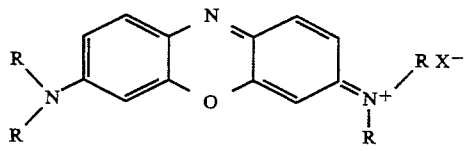

As shown in Chem. 1, the cationic dye is dissociated into the cation and the anion in an aqueous solution. The counter ion, $x^-$, for the cation usually consists of an inorganic ion such as of a halogen.

In this example, the counter ion, $x^-$, is exchanged with a strongly hydrophobic organic ion, thereby obtaining a salt which is insoluble or sparingly soluble in water.

The strongly hydrophobic organic ion used is an anionic surface active agent. In this example, dodecylbenzenesulfonate is used as the anionic surface active agent.

The preparation procedure of the dye according to the invention is described.

3 g of the cationid dye (cyan) is dissolved in 200 cc of water, in which a 20 wt % aqueous solution of dodecylbenzenesulfonic acid is dropped. As a result, ion exchange with the anionic surface active agent takes place, thereby precipitating fine crystals with a metallic gloss in a large amount.

300 cc of chloroform is added to the mixed solution containing the fine crystals, followed by extraction by the use of a separating funnel. The dye is transferred to the chloroform phase.

A similar extraction procedure is repeated using the cationic dye which has not been subjected to ion exchange treatment with the anionic surface active agent, resulting in the dye being substantially left in the aqueous phase. From this, it is will be appreciated that the dye of the invention subjected to the ion exchange treatment is remarkably improved with respect to the compatibility with organic solvents or the hydrophobic properties.

More particularly, the substance indicated in Chem. 2 is formed by the ion exchange treatment.

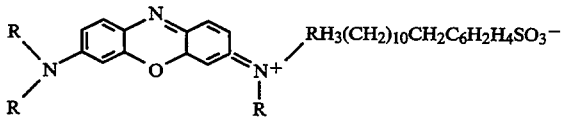

Figure 1:
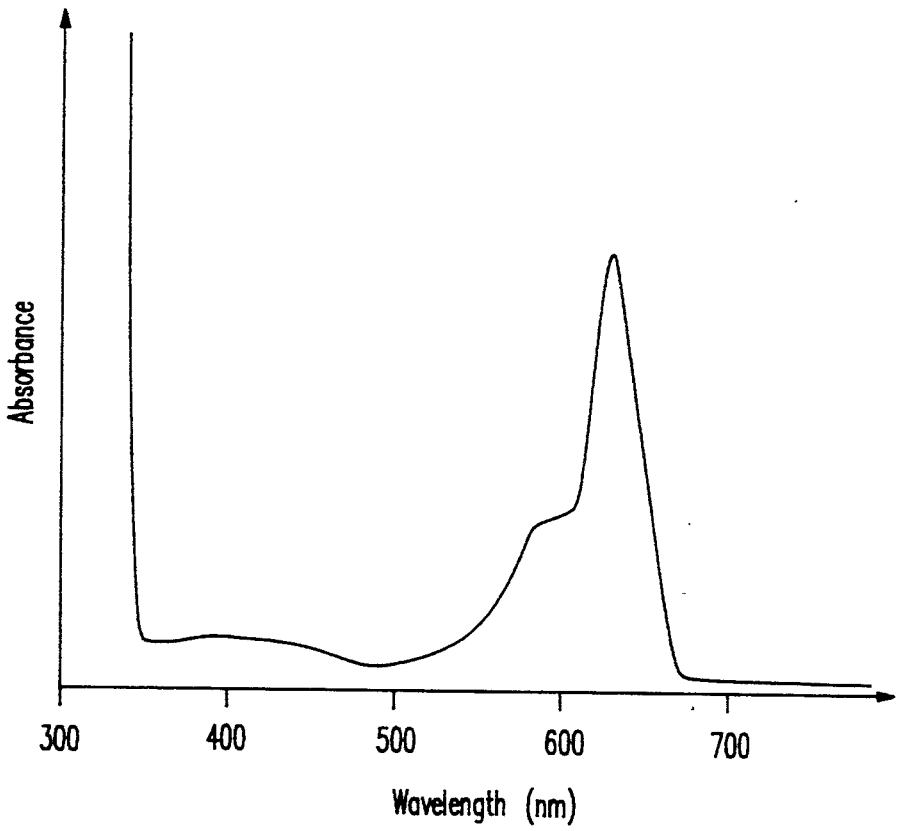
FIG. 1 is a view showing absorption spectra of a dye of the invention in MEK.

The dye of the invention is subjected to measurement of absorption spectra in methyl ethyl ketone (MEK), with the result that little variation takes place prior to and after the ion exchange treatment, the chart being as shown in FIG. 1.

After the ion exchange treatment, the organic chloroform phase is collected, from which the solvent is distilled off under reduced pressure, followed by drying at 50° C. at a reduced pressure to obtain about 4 g of a solid matter. The measurement of the melting point of the dye is 80° C., which is lower by 40° C. than that of the starting material.

The dye obtained by the above procedure is dissolved in a solution of a hydrophobic polyvinyl butyral binder resin (commercial name: PVB3000K, available from Sekisui Chem. Co., Ltd.) in MEK/toluene to obtain a coating solution. The solution has the following formulation.

| | Parts by Weight |
|---|---|
| Polyvinyl butyral | 1 |
| Dye | 1 |
| MEK/toluene (1/1 by weight) | 50 |

Figure 2:
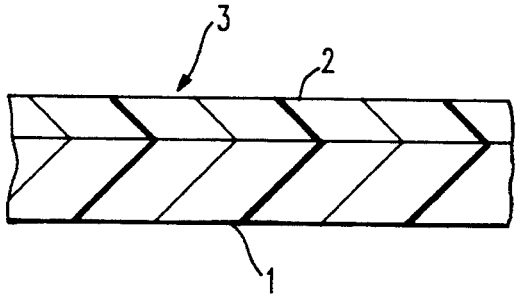
FIG. 2 is an enlarged, sectional view of a ribbon of the invention.

The solution is applied onto a polyethylene terephtalate (PETP) film by means of a wire bar and dried at room temperature, followed by drying in an oven at a temperature of 120° C. for 2 minutes. As a consequence, there is obtained a ribbon 3 having a 1 micrometer thick coloring layer 2 on the PETP film as shown in FIG. 2.

Figure 3:
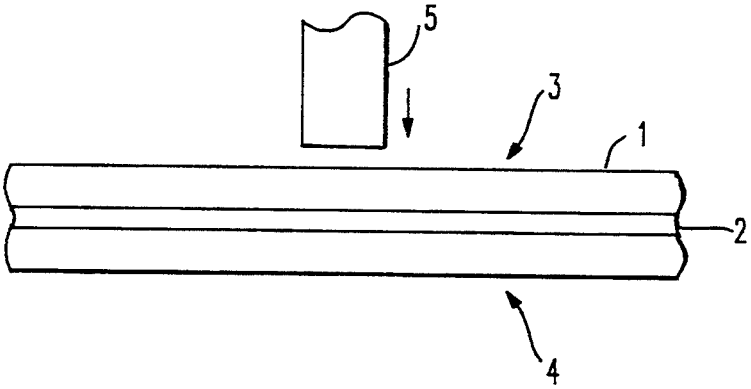
FIG. 3 is a schematic illustrative view of a thermal transfer procedure.
Figure 4:
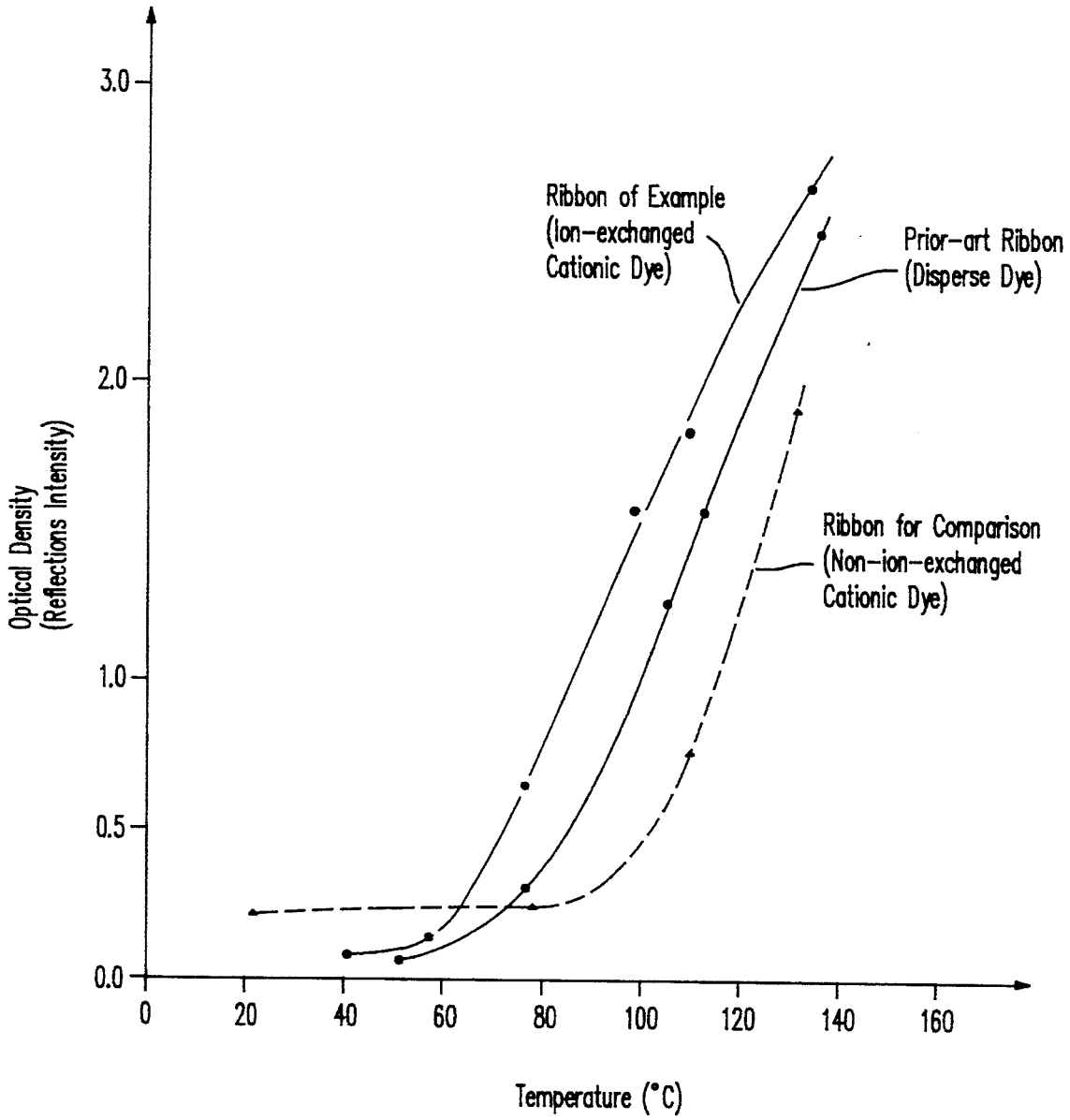
FIG. 4 is a graph showing an optical density of ribbons of the invention, prior art and for comparison.
Figure 5:
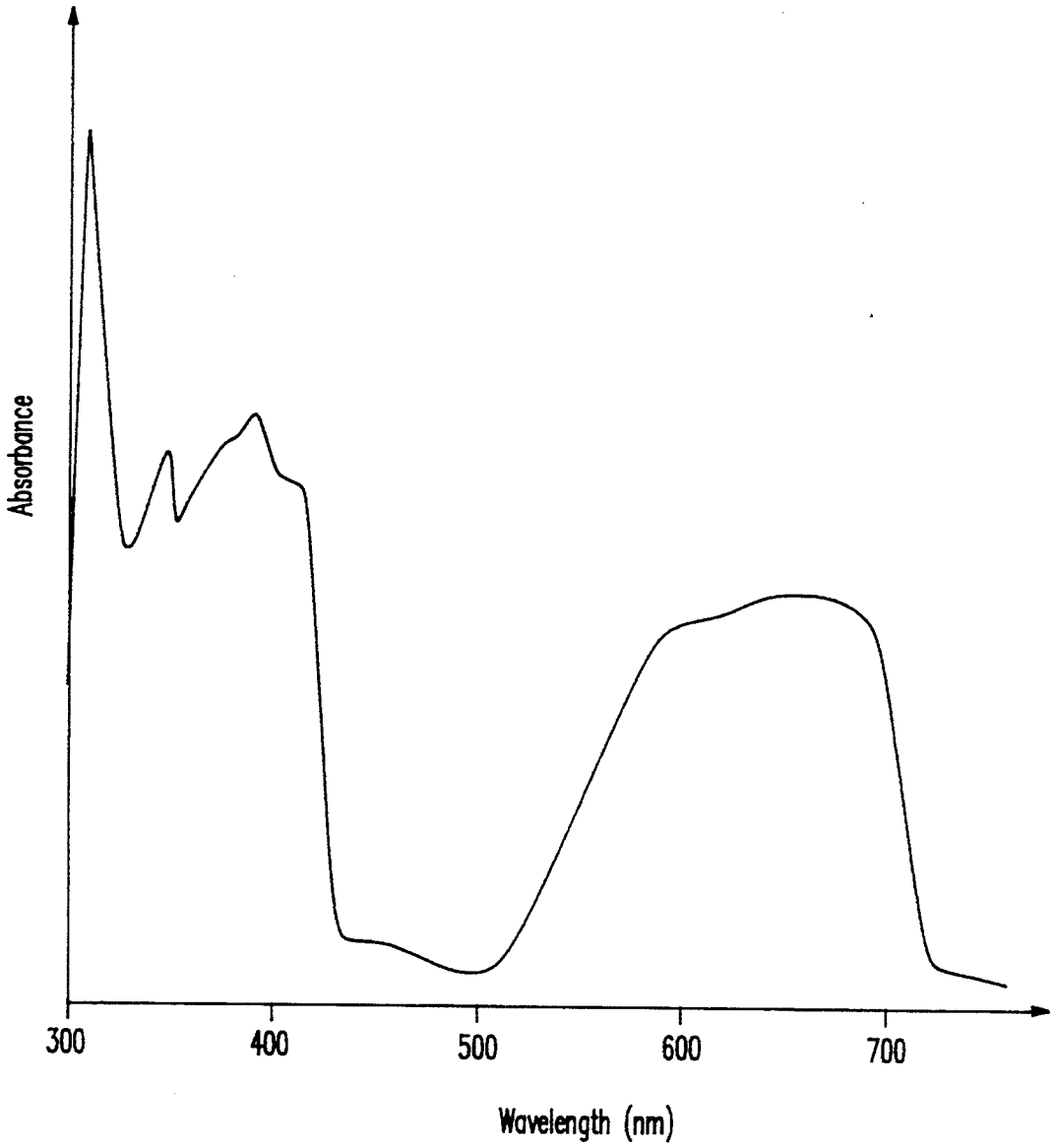
FIG. 5 is a view showing absorption spectra of an image obtained by the use of a ribbon of the invention.

As shown in FIG. 3, the ribbon 3 is stacked on a photographic paper 4 (commercial name: VPM-30ST, available from Sony Corporation) and pressed at a pressure of 20 g/cm$^2$ by means of a recording head 5 for 20 seconds to thermally transfer the dye. The printing paper has an acceptor layer formed of hydrophobic polyester resin on a paper substrate. The temperature of the recording head 5 is changed for the thermal transfer to measure an optical density (reflection density) at the different temperatures. The results are shown in FIG. 4. A similar test is made on a commercial ribbon using a disperse dye. The results are also shown in FIG. 4.

As will be seen from FIG. 4, the ribbon of the example has an electrostatic sensitivity characteristic equal to or higher than the commercial ribbon using the disperse dye over an entire temperature range.

On the other hand, when a ribbon is made using the dye which has not been subjected to the ion exchange treatment, the dye is not compatible with the MEK/toluene mixed solution of the solvent and the binder polymer an polyvinyl butyral, so that a uniform coloring layer is not obtained with a good color development being not expected.

In order to confirm the utility of the dye in this example the cationic dye, which has not been ion-exchanged, is used to form a ribbon using a combination of compatible solvents (ethanol, water) and a binder resin (polyvinyl acetate: PVA) for comparative purpose. As shown in FIG. 4 the ribbon is disadvantageous in exhibiting a high color-developing temperature, a low maximum density, a high degree of fogging and a high moisture absorption of the film and is not of the practical utility. The composition of the ribbon-forming coating solution using the non-treated dye is shown below.

| | Parts by Weight |
|---|---|
| Polyvinyl chloride | 1 |
| Dye | 1 |
| Etanol/water (1/1 by weight) | 100 |

Figure 6:
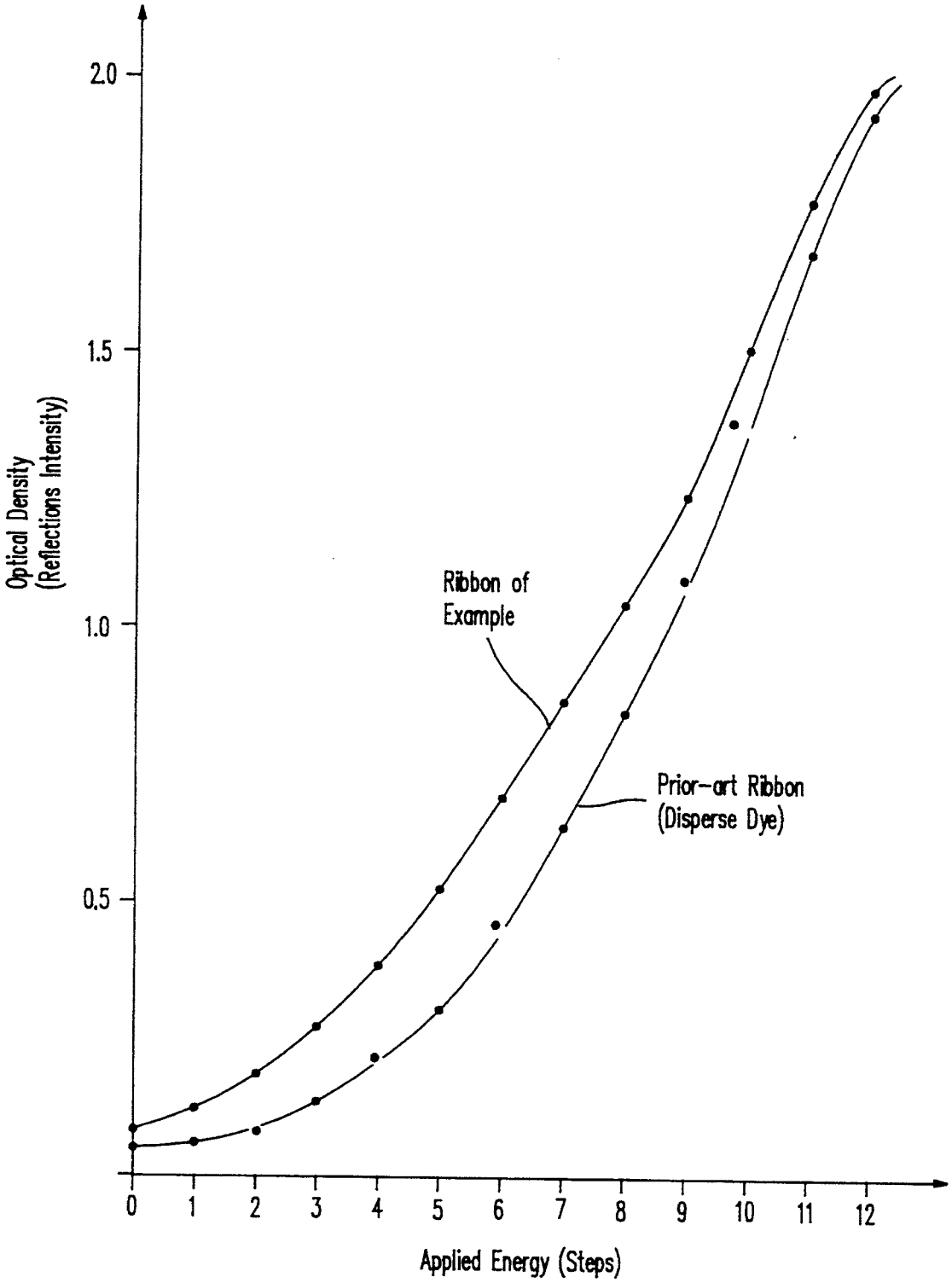
FIG. 6 is a graph showing a dynamic sensitivity characteristic of ribbons of the invention and prior art.

Subsequently, the ribbon 3 obtained in the above procedure is set in a ribbon cassette (not shown) and used to monochromatically print on a photographic paper by the use of a color video printer, not shown, (commercial name: CVP-G500, available from Sony Corporation), with the result that the absorption spectra in the resin of the cording layer of the photographic paper assume a good cyan color with the picture having a good half-tone gradation. The so-called dynamic sensitivity (color development) characteristic of the picture is shown in FIG. 6.

As shown in the figure, in the ribbon 3 of the example, an optical density (reflection density) is higher than that of the commercial ribbon at the same step. Thus, it will be seen that the dynamic sensitivity characteristic is improved over the known ribbon using the disperse dye.

The steps of the abscissa axis of the figure indicate stepwise energy levels which are added for image recording.

As stated hereinabove, the dye of this example is obtained by ion exchanging of the inorganic counter ion of the cationic dye with the anionic surface active agent having a hydrophobic organic ion. The dye can be applied as a cationic dye which has not been conventionally employed as a dissolution-type ribbon dye for the thermal transfer system, causing the choice of dyes for ink ribbons to be widened.

When an ink ribbon is made using the dye of the example, the sensitivity, hue and light fastness can be improved at the time of the transfer.

Moreover, the dye of the example can be prepared from inexpensive, commercially available cationic dyes and anionic surface active agents and the preparation procedure is simple, so that the product can be obtained at low production costs.

In the above example, the oxazine cationic dye is used, to which the invention is not limited, and a variety of cationic dyes can be used.

The anionic surface active agents used as the hydrophobic organic ion include, aside from the dodecylbenzenesulfonic acid, a number of agents indicated below.

(1) Carboxylates (1) Soaps ($RCOO^-$)

(2) N-acylamino acid salts ($RCON—COO^-$)

(3) Alkyl ether carboxilates ($(RO(C_2H_4O)_nCOO^-$)

(4) Acrylated peptides (RCON—COO−)

(2) Sulfonates (1) Alkylsufonates ($RSO_3^-$)

(2) Alkylbenzenesulfonates represented by the formula

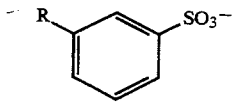

(3) Alkylnaphthalenesulfonates represented by the formula

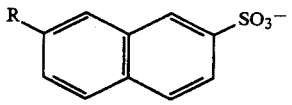

(4) Sulfonsuccinates represented by the formula $$R-OCOCH_2\underset{\underset{SO_3^-}{|}}{C}HCOOR$$

(5) α-Olefinsulfonates (6) N-Acylsulfonates (—CON—$SO_3^-$)

(3) Surfuric esters (1) Sulfated oils (2) Alkylsulfates ($ROSO_3^-$)

(3) Alkyl ether sulfates ($R—O(C_2H_4O)nSO_3^-$)

(4) Alkyl allyl ether sulfates represented by the formula

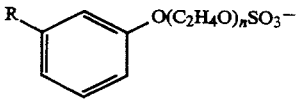

(5) Alkylamido sulfates (RCONH—OSO3−)

(4) Phosphoric esters (1) Alkyl phosphoric eters represented by the formulas $$O=\overset{\overset{O^-}{|}}{\underset{\underset{O^-}{|}}{P}}-OR$$

-continued $$O=\overset{\overset{OR_1}{|}}{\underset{\underset{O^-}{|}}{P}}-OR_2$$

(2) Alkyl ether phosphoric acids represented by the formulas $$O=\overset{\overset{O^-}{|}}{\underset{\underset{O^-}{|}}{P}}-O(C_2H_4O)_nR$$

$$O=P-\overset{\overset{O(C_2H_4O)_nR_1}{|}}{\underset{\underset{O^-}{|}}{O}}(C_2H_4O)_nR_2$$

(3) Alkyl allyl ether phosphates

In the above formulas, R, $R_1$ and $R_2$ are, respectively, an alkyl chain having, preferably, 10–20 carbon atoms. This is because of the ease in obtaining starting materials and in preparing the dyes.

As stated above, the dyes for ink ribbons of thermal transfer systems according to the invention wherein an inorganic counter ion of cationic dyes is exchanged with a hydrophobic organic ion are advantageous in that cationic dyes which have never been employed hitherto as a dye for the dissolution-type ribbon of thermal transfer systems can be applied with a wide selection of dyes for ink ribbons.

The coloring layer made of the dye of the invention is formed on a support to obtain an ink ribbon having good sensitivity, hue and light fastness at the time of the thermal transfer.

We claim as our invention:

1. A dye carrier ink ribbon, comprising a substrate and an ink layer formed on said substrate, said ink layer being formed of a) a binder and b) a hydrophilic cationic dye in which the inorganic counter ion in said cationic dye is exchanged with a hydrophobic organic ion, and wherein the hydrophobic organic ion is derived from anionic surface active agents.

2. A thermal dye transfer hard copy system, comprising:

a dye carrier ink ribbon having a) a binder and b) a cationic dye in which the inorganic counter ion is exchanged with a hydrophobic organic ion, the hydrophobic organic ion being derived from anionic surface active agents;

an acceptor sheet having a layer formed of a hydrophobic organic material, and which is in contact with the dye carrier ink ribbon; and a thermal means for applying heat to the dye carrier ink ribbon.

* * * * *